US011284714B2

(12) United States Patent
Rayos

(10) Patent No.: US 11,284,714 B2
(45) Date of Patent: Mar. 29, 2022

(54) FOOD AND DRINK DRIP GUARD AND UTILITY TOP AND METHOD FOR MAKING THE SAME

(71) Applicant: Richard C Rayos, Warren, MI (US)

(72) Inventor: Richard C Rayos, Warren, MI (US)

( * ) Notice: Subject to any disclaimer, the term of this patent is extended or adjusted under 35 U.S.C. 154(b) by 183 days.

(21) Appl. No.: 16/660,395

(22) Filed: Oct. 22, 2019

(65) Prior Publication Data

US 2020/0281350 A1 Sep. 10, 2020

Related U.S. Application Data

(60) Provisional application No. 62/748,982, filed on Oct. 22, 2018.

(51) Int. Cl.

| | |
|---|---|
| ***A47B 23/00*** | (2006.01) |
| ***A47G 23/06*** | (2006.01) |
| *A41B 13/10* | (2006.01) |
| *A41D 13/04* | (2006.01) |

(52) U.S. Cl.

CPC ..... *A47B 23/002* (2013.01); *A47G 23/0608* (2013.01); *A41B 13/10* (2013.01); *A41D 13/04* (2013.01)

(58) Field of Classification Search

CPC A47G 23/0608; A47G 21/001; A47B 23/002; A45F 2003/001; A45F 3/00; A41B 13/10

See application file for complete search history.

(56) References Cited

U.S. PATENT DOCUMENTS

| | | | | | |
|---|---|---|---|---|---|
| 83,120 | A | * | 10/1868 | Mott | A41B 13/106 2/49.5 |
| 3,407,757 | A | * | 10/1968 | Warner | B64D 43/00 108/43 |
| 4,243,249 | A | * | 1/1981 | Goss | B42F 9/001 108/43 |
| 4,815,623 | A | * | 3/1989 | Levin | A47G 23/0608 220/17.1 |
| 5,069,375 | A | * | 12/1991 | Flick | B60N 3/005 224/564 |
| 5,074,222 | A | * | 12/1991 | Welch | A47B 23/002 108/43 |
| 5,075,897 | A | * | 12/1991 | Daniels | A41B 13/10 2/48 |
| 5,081,936 | A | * | 1/1992 | Drieling | B60N 3/002 108/25 |
| 5,143,341 | A | * | 9/1992 | Juster | A47B 21/0314 248/118 |
| 5,181,275 | A | * | 1/1993 | Spulgis | A41B 13/10 2/48 |
| 5,209,370 | A | * | 5/1993 | Pickett | A47B 23/002 206/557 |

(Continued)

*Primary Examiner* — Jonathan Liu
*Assistant Examiner* — Taylor L Morris
(74) *Attorney, Agent, or Firm* — Panagos Kennedy PLLC; Bill Panagos; Linda Kennedy

(57) ABSTRACT

A flexible lap food and beverage drip guard is disclosed. The food and drip guard may include a non-slide surface to act as a desk top for mobility devices such as, for example, cell phones and lap top computers. The device may further include textured upper surface to divert the flow of fluids to a catch pocket on either side of the device, and the bottom surface may be textured or honey combed to provide insulating properties to the user.

4 Claims, 4 Drawing Sheets

(56) References Cited

U.S. PATENT DOCUMENTS 5,355,811 A * 10/1994 Brewer ..... A47B 21/0314 108/43
5,497,885 A * 3/1996 Sussman ..... A47G 19/065 206/217
5,513,576 A * 5/1996 Ward ..... A47B 23/002 108/43
5,520,119 A * 5/1996 Eisenberg ..... A47B 23/002 108/43
5,720,226 A * 2/1998 Padovano ..... A47B 23/002 108/25
5,732,910 A * 3/1998 Martin ..... G06F 3/0202 248/118
5,799,795 A * 9/1998 Mease ..... A47G 23/0608 206/564
5,862,933 A * 1/1999 Neville ..... A47B 23/002 220/17.1
5,937,765 A * 8/1999 Stirling ..... A47B 23/002 108/43
5,956,763 A * 9/1999 Blackshear ..... A41B 13/106 2/49.1
6,032,586 A * 3/2000 Reyes ..... A47B 23/041 108/25
6,041,715 A * 3/2000 Jarke ..... A47B 23/002 108/43
6,050,200 A * 4/2000 Sullins ..... A47B 23/002 108/25
6,050,201 A * 4/2000 Blanchard ..... A47B 23/002 108/43
6,095,058 A * 8/2000 Earnhart ..... A47B 23/002 108/43
6,116,165 A * 9/2000 Kadesky ..... A47B 23/002 108/161
D435,377 S * 12/2000 Galati, Jr. ..... D6/707
6,173,656 B1 * 1/2001 Blanchard ..... A47B 23/002 108/43
6,302,033 B1 * 10/2001 Roudebush ..... A47D 1/0085 108/25
6,305,532 B1 * 10/2001 Overkamp ..... A47B 13/16 206/217
6,520,337 B2 * 2/2003 Smith ..... B65D 81/113 206/470
6,578,496 B2 * 6/2003 Guard ..... A47G 19/10 108/25
6,708,341 B1 * 3/2004 Schaller ..... A41D 13/04 2/48
6,780,079 B2 * 8/2004 Musacchia, Jr. .... A01M 31/004 224/222
6,789,265 B1 * 9/2004 Vonrinteln ..... A41B 13/103 2/48
6,986,308 B1 * 1/2006 King ..... A47G 23/0608 108/25
7,140,304 B1 * 11/2006 Lawrie ..... B25H 3/06 108/25
7,178,170 B2 * 2/2007 Thompson ..... A41B 13/103 2/48
7,806,059 B2 * 10/2010 Bolton ..... G06F 1/181 108/43
D644,005 S * 8/2011 Davis ..... A47B 21/0314 D2/864
7,992,714 B1 * 8/2011 Devault ..... A47G 19/10 206/564
9,254,031 B1 * 2/2016 Zenoff ..... A45F 5/021
9,289,015 B2 * 3/2016 Kassis ..... A41B 13/106
9,486,072 B1 * 11/2016 Chapman ..... A01K 1/0353
9,919,842 B2 * 3/2018 Di Tata ..... B65D 25/20
10,799,035 B2 * 10/2020 Tollett ..... F16M 13/04
10,919,486 B1 * 2/2021 Moore ..... B60R 22/14
2001/0032791 A1 * 10/2001 Hudson ..... A47G 23/02 206/217
2003/0121586 A1 * 7/2003 Mitra ..... C09J 7/22 156/66
2003/0159191 A1 * 8/2003 Nornes ..... A41B 13/10 2/49.1
2004/0178540 A1 * 9/2004 Huisman ..... C08L 3/02 264/478
2004/0245146 A1 * 12/2004 Kulp, III ..... A47G 23/0608 206/557
2004/0262485 A1 * 12/2004 Marceau ..... F16M 11/22 248/346.01
2005/0211138 A1 * 9/2005 Gupta ..... D03D 15/69 108/43
2006/0080751 A1 * 4/2006 Thompson ..... A47G 23/0608 2/48
2007/0089646 A1 * 4/2007 Duncan ..... A47B 23/002 108/43
2007/0113757 A1 * 5/2007 Lilly ..... A47B 23/002 108/25
2007/0277711 A1 * 12/2007 Grant ..... A47G 23/0608 108/160
2010/0133268 A1 * 6/2010 Miller ..... A47G 23/0608 220/17.1
2011/0139039 A1 * 6/2011 Peters ..... A47B 23/002 108/42
2013/0295241 A1 * 11/2013 Wesby ..... B65D 5/667 426/115
2015/0108123 A1 * 4/2015 Linehan ..... A47B 23/002 220/17.1
2016/0325197 A1 * 11/2016 Smith ..... A47G 23/0608
2017/0127811 A1 * 5/2017 Young ..... A47B 23/002
2017/0318944 A1 * 11/2017 Murrey ..... B65D 81/3876
2018/0206558 A1 * 7/2018 Bannan ..... A41D 13/04
2019/0380401 A1 * 12/2019 Meckle ..... A47G 23/06
2020/0128953 A1 * 4/2020 Goldhammer ..... A47B 23/06

* cited by examiner

FOOD AND DRINK DRIP GUARD AND UTILITY TOP AND METHOD FOR MAKING THE SAME

TECHNICAL FIELD

In one embodiment, the present disclosure relates to a re-useable travel food and drip guard for use in an automobile or other vehicle or for any other mobility mode. It has been a continuing problem for those traveling via automobile to eat in their cars or in any other mobility mode of travel, such as commuting. Limited space and the demands of travel often result in food or beverage dripping from the hand in which it is held onto the traveler's lap. An apron over the entire lap of the vehicle operator has not been a success because it restricts the ability of the operator to control the vehicle. In addition, a paper towel or napkin over the leg is not entirely acceptable because such a paper product will invariably get wet and lose any protective ability. In addition, paper coverings are not reusable. It has been a particular issue that the food and beverage drip usually occur over the leg that is on the same side as the hand that is holding the food or beverage. There is a continuing need for a reusable food and beverage drip guard that protects the vehicle operator's (or passenger's) clothing but does not restrict the operator or passenger of the vehicle.

Additionally, with today's necessities of personal electronic devices such as cell phones, tablet computer, laptops etc. people are looking for additional means to hold and present their devices while working in their vehicles or any other location that is not their desk. Legs are a common surface to place these devises. The problem is that any slight movement would cause these devices to slip off and fall. The material and features that would be used to construct the food, drip guard and utility top would also allow it to function as a non-slip working surface.

SUMMARY

In one embodiment, the present disclosure is directed to a reusable food and beverage drip guard and a method for making the same. The reusable food and beverage drip guard may be formed of a flexible water-proof elastomer sheet with a diverter surface of sufficient length and width to cover the upper portion of a leg. Generally (but not always) the diverter surface has a length greater than its width. The diverter surface has opposed diverter walls separated by the divert surface along the entire width of the diverter. The diverter surface has opposed channels separated by the diverter surface along the length of the diverter surface. The diverter walls intersect with and join the channels to present an apparatus that will permit food and beverages dropped onto the covered leg of a person to travel to the channels without soiling or staining the clothing of the person using the food and beverage drip guard.

In one embodiment, the food and beverage drip guard is made by applying a mold release onto an arcuate or semicircular mold with detail to form the diverter walls and channels, and applying an elastomer, such as a silicon, to the mold. When cured, the elastomer is removed to make the re-useable food and beverage drip guard. It is important to note that with an arcuate mold, the diverter walls will also be substantially perpendicular to the arcuate form and thereby erect during use to present an effective barrier to beverages or food from dripping off the diverter surface and onto the user's clothing.

DETAILED DESCRIPTION OF THE DRAWINGS

Figure 4:
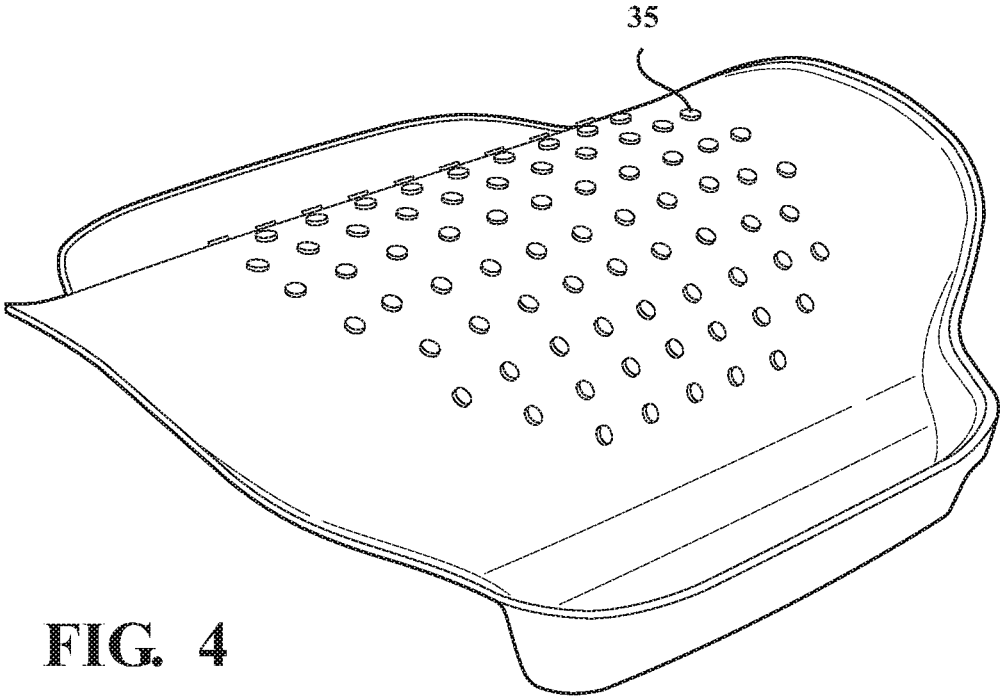
FIG. 4 is a top perspective view of the food and drip guard showing a textured diverter surface.
Figure 5:
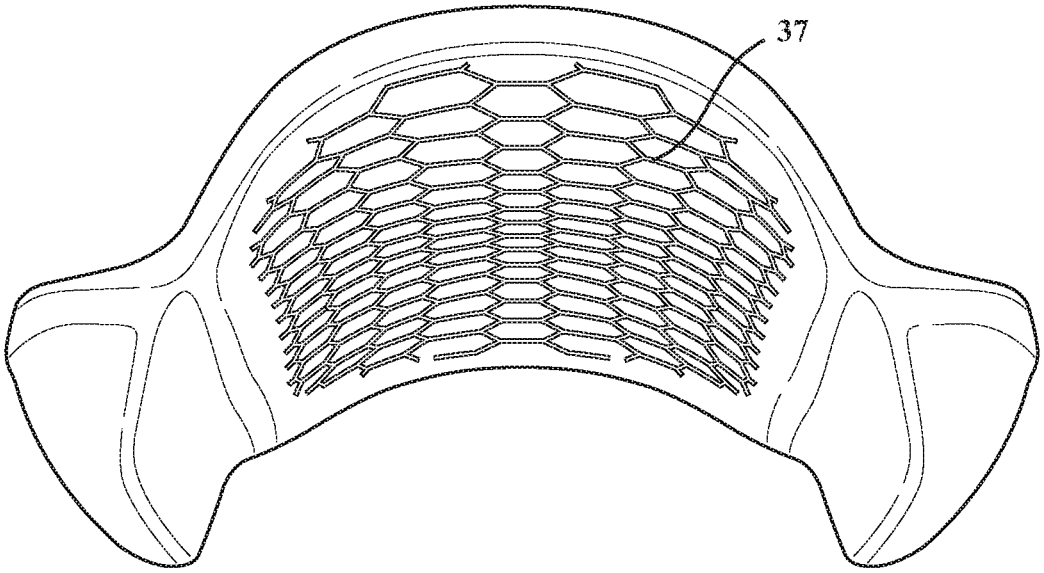
FIG. 5 is a bottom perspective view of the food and drip guard showing a textured bottom surface.

Turning now to the drawings wherein like numbers refer to like structures, food and beverage drip apparatus 10 (shown in a curved state) has a length 12 and a width 14. The apparatus 10 has a diverter surface 16 extending the entire length and width of the apparatus. While the diverter surface is shown as generally rectangular, it could include extensions or be configured to cover the groin area of the user. The embodiments of the Figures include a diverter surface having opposed drip barrier walls 18 and 20 along the width separated by the diverter surface 16. Along the length of the apparatus are opposed channels 22 and 24, separated by the diverter surface. The channels have opposed walls 26 and 28, joined at arcuate surface 30 to from the channel. The channel may be further equipped with absorbent material insert 32 along the arcuate surface to absorb any liquids that may pool in the channels. The diverter surface may be smooth to permit the free flow of liquids to the channels and/or may have embossed or raised design features 35 (see FIG. 4) to slow down or control the flow of liquids to the channel. The addition of the raised design features on the top surface 16 may also add to the utility of the device and make it a functional nonslip work surface for such devices but not limited to cell phones and tablets. To that end, the device may be positioned over the center console arm rest and the cell phone, lap top or tablet may be positioned thereon with assurance that it will not slip from position. As seen in FIG. 5, the opposite surface 34 may be textured to ensure it stays in place on the leg of the user, or if it is smooth, the surface is made of material that has anti-skid properties to keep it in place on the user's leg. Also, this opposite surface 34 may have embossed designs such as but not limited to a honey comb 37, to not just add to the nonslip characteristic of the food, drip and utility top the user's leg, but would also form air pockets that would add to the utility of a thermal barrier should a very hot liquid such as but not limited to coffee spill on the leg of the user. In other embodiments, the apparatus may include a catch to secure the drip apparatus to a console or door or other surface of the vehicle interior.

The food and beverage drip guard may be made of an elastomer material that is waterproof and flexible. Suitable elastomer materials may be selected from (but are not limited to) rubber (both synthetic and natural), isoprene rubber, nitrile rubbers, ethylene propylene rubber, latex, neoprene, silicone, fluroelastomers, flurosilicone, to name a few. It is contemplated that in addition to being water-proof, the material used to make the apparatus have thermal protection properties so if hot liquid is dripped to the apparatus, the user will not suffer any heat discomfort or burns.

The mold 36 has an arcuate or semi-circular profile 38 with grooves along the width to form the diverter walls when an elastomer is applied to it. There are smaller arcuate surfaces 40 on either side of the profile 38 to form the channels. In operation, a mold release agent may be applied to the mold, and the elastomer is then applied. The elastomer cures and the mold release agent facilitates the easy removal of the cured food and beverage drip guard.

Figure 1:
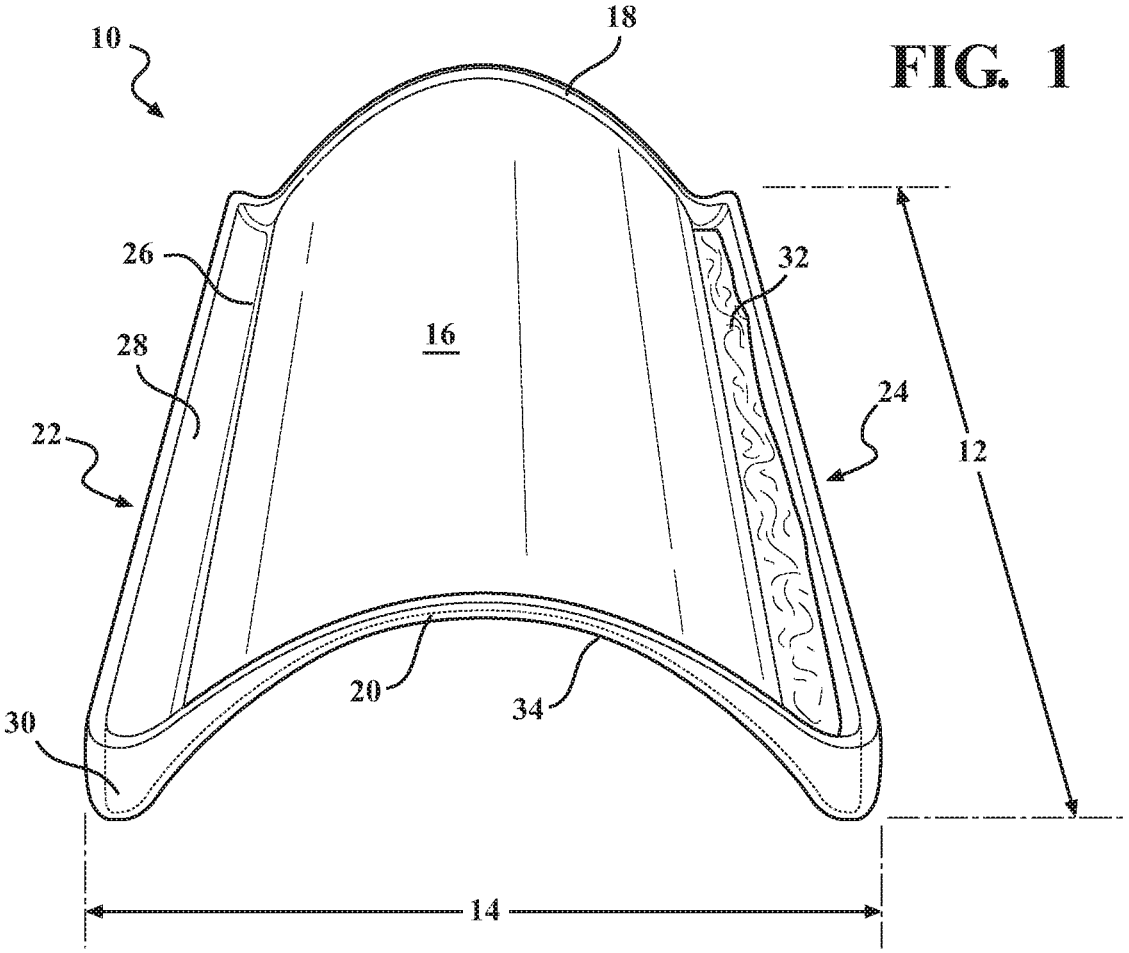
FIG. 1 is a view of one embodiment of the food and drip guard with arcuate diverter walls and channels.
Figure 2:
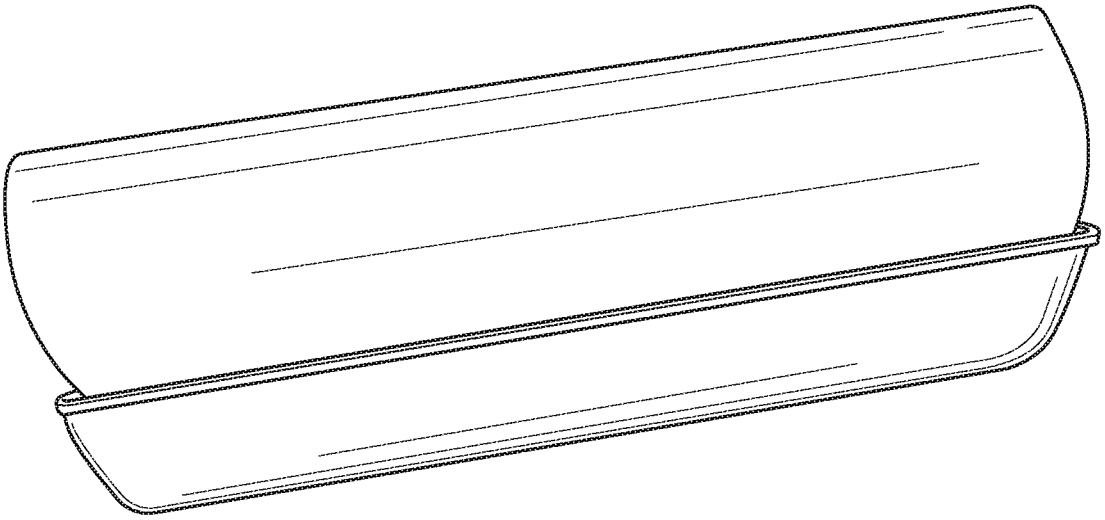
FIG. 2 is a view of the food and drip guard of FIG. 1 in a rolled up position.
Figure 3:
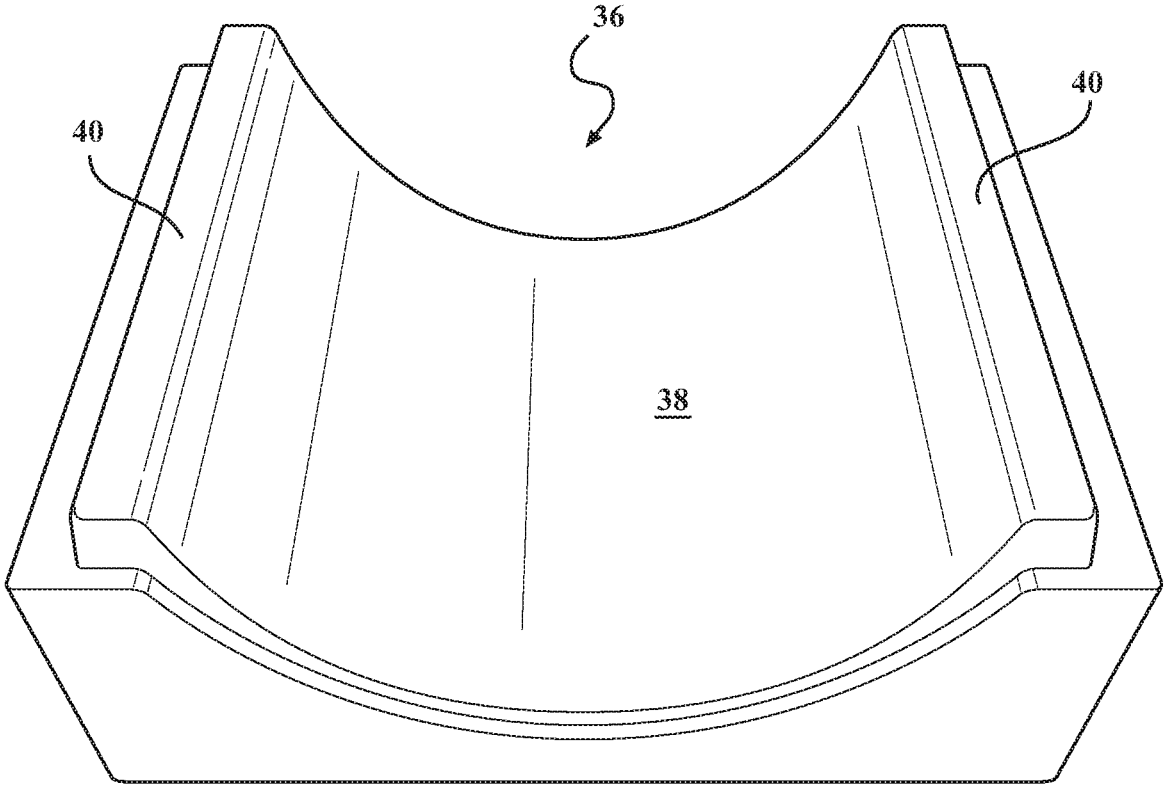
FIG. 3 is a view of one embodiment of a mold to make a food and beverage drip guard.
Figure 6:
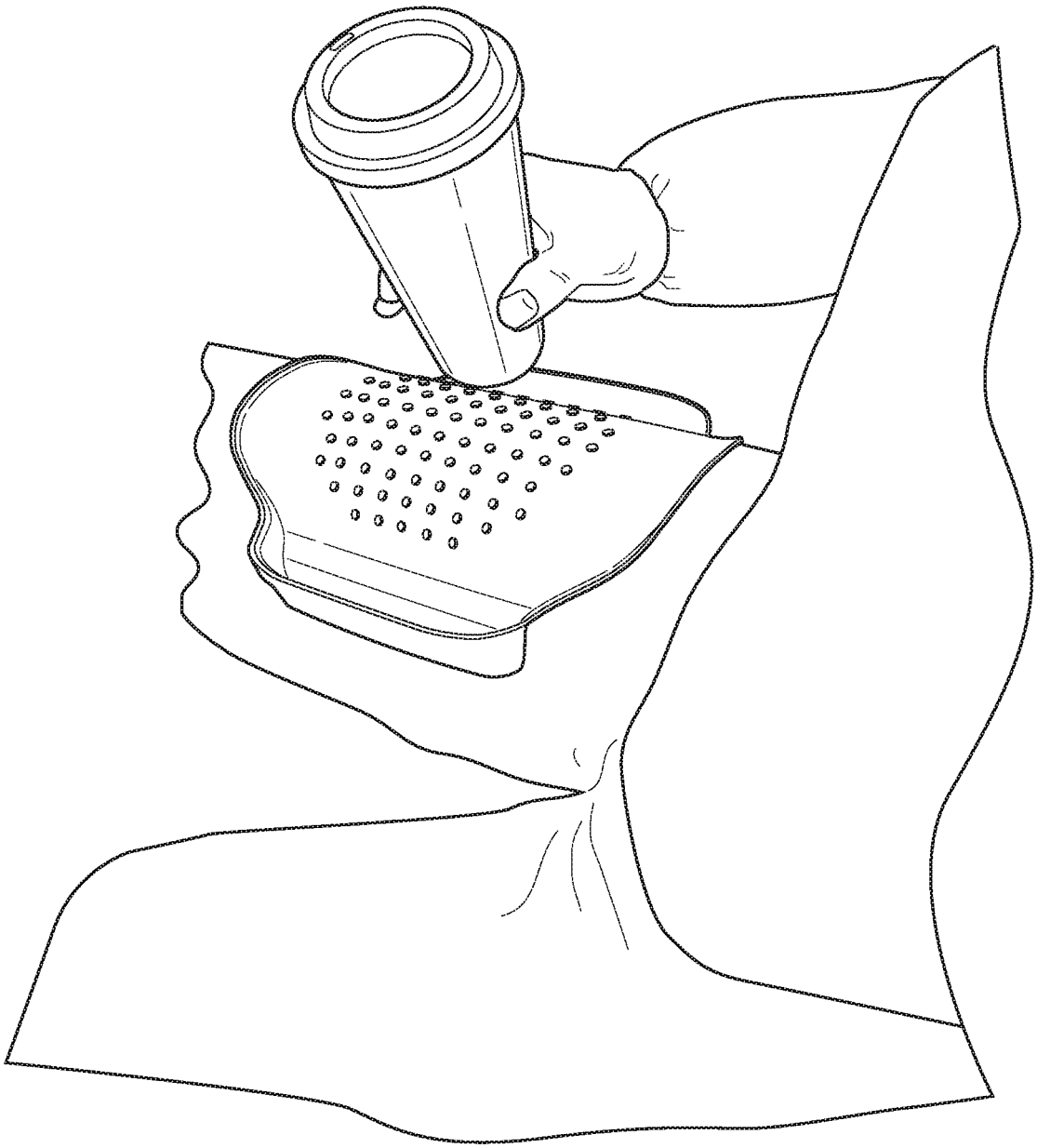
FIG. 6 is a top plan view of the food and drip guard apparatus on a user's leg in a vehicle.

In operation, the food and drip guard apparatus is placed over the right leg (see FIG. 6) when the food or beverage is on the right hand and over the left leg when the food or beverage is held in the left hand. Any drips are then intercepted by the apparatus and the liquid flows into the channels in the apparatus. After cleaning, the apparatus may be rolled into a compact form for storage as seen in FIG. 3.

Those skilled in the art recognize the words used in this application are words of description, not words of limitation. Many variations are possible without departing from the scope and spirit of the invention.

What is claimed:

1. A food and beverage drip guard comprising: An arcuate flexible waterproof diverter member having a length and a width, said diverter member having a top surface and a thermal barrier bottom surface; said top surface having a non-slip work area; said thermal barrier bottom surface being textured to cause the food and beverage drip guard to remain in place when the food and beverage drip guard is positioned over an object; opposed diverter walls extending along the width of the diverter member that are substantially perpendicular to and separated by said top surface; and opposed channels extending along the length of the diverter member.

2. The food and beverage drip guard of claim 1, wherein said non slip work area includes raised features arranged on the top surface.

3. The food and beverage drip guard of claim 1, wherein said thermal barrier bottom surface is formed of embossed air pockets.

4. The food and beverage drip ward of claim 1, further including a liquid absorbent material insert in said opposed channels.

* * * * *